United States Patent [19]

Weir

[11] Patent Number: 4,733,021

[45] Date of Patent: Mar. 22, 1988

[54] LINE TIE ASSEMBLY WITH CAPTURED CUSHIONING PAD

[75] Inventor: James A. Weir, Carthage, Tex.

[73] Assignee: Helical Line Products Company, Rocky River, Ohio

[21] Appl. No.: 948,308

[22] Filed: Dec. 31, 1986

[51] Int. Cl.[4] ..... H01B 17/22

[52] U.S. Cl. ..... 174/173; 174/DIG. 12

[58] Field of Search ..... 174/172, 173, DIG. 12; 24/115 N, 129 C, 131 C; 57/906

[56] References Cited

U.S. PATENT DOCUMENTS

| | | | |
|---|---|---|---|
| 2,182,342 | 12/1939 | Karitzky | 174/DIG. 12 X |
| 3,154,633 | 10/1964 | Little | 174/DIG. 12 X |
| 3,288,918 | 11/1966 | Schlein | 174/DIG. 12 X |
| 4,015,073 | 3/1977 | Dickerson | 174/DIG. 12 X |

FOREIGN PATENT DOCUMENTS

| | | | |
|---|---|---|---|
| 860169 | 9/1940 | France | 174/173 |

OTHER PUBLICATIONS

Preformed line Products Co. advertisement: *Electrical World*, vol. 167, No. 6, Feb. 6, 1967; pp. 38 and 39.

*Primary Examiner*—Laramie E. Askin

*Attorney, Agent, or Firm*—Tarolli, Sundheim & Covell

[57] ABSTRACT

A line tie assembly for securing an elongated line conductor to a line support insulator includes a pair of single-strand line tie components. The line tie components each have a pair of leg portions with helical preformed configurations and a generally U-shaped bight portion integrally interconnecting the leg portions. A generally flat flexible cushioning pad composed of resilient material is pivotally connected to and extends between the bight portions of the line tie components. The bight portions of the respective line tie components hook about a reduced diameter neck portion of the insulator on opposite sides thereof. The leg portions wrap about respective adjacent portions of the line conductor on opposite sides of the insulator for securing the line conductor to the insulator. The cushioning pad is placed between the conductor and a groove in the head portion of the insulator in which the conductor will be retained by the line tie assembly. The cushioning pad has a pair of opposing tabs to releasably attach the pad to the bight portions of the line tie components such that the pad extends therebetween in a captured relationship.

22 Claims, 6 Drawing Figures

LINE TIE ASSEMBLY WITH CAPTURED CUSHIONING PAD

BACKGROUND OF THE INVENTION

1. Field of the Invention

The present invention relates to connectors used for securing power lines to support insulators. More particularly, the present invention relates to a line tie assembly having a pair of line tie components and a protective cushioning pad for location between the support insulator and the power line.

2. Description of the Prior Art

Power line conductors have heretofore been secured to insulators by line ties which are applied by a linesman. The line tie is ordinarily wrapped around respective portions of the conductor located adjacent to opposite sides of the insulator and around the neck of the insulator after the conductor is laid in a top groove formed in the insulator head. Many different forms of line ties appear in the prior art. Known line ties are disclosed in U.S. Pat. Nos. 3,042,745; 3,288,918; 3,295,311; 3,406,513; and 4,015,073. In addition, an example of a known insulator protector located between an insulator and a conductor is disclosed in U.S. Pat. No. 2,361,109.

The line tie is configured to impose a tight frictional grip on the line conductor sufficient to resist axial movement of the conductor relative to the insulator. However, it is well known that line conductors move and oscillate due to wind and other climatic forces to which they are subjected. Movement or oscillation of the conductor against the insulator results in abrasion of the conductor and damage to the insulator head. Therefore, a protective tube or pad, as disclosed in U.S. Pat. No. 4,015,073, is typically applied between the conductor and insulator head to prevent such abrasion and damage. This protective device is supposed to be deployed by the linesman at the time the line tie is applied to secure the conductor to the insulator. However, frequently, the linesman fails to apply the protective device and abrasive damage results which reduces the expected life of one or both of the conductor and insulator.

A special tool, called a "Hotstick", is used to apply a line tie, for example the line tie disclosed in U.S. Pat. No. 3,042,745, to a conductor when the conductor is carrying electricity. The typical procedure is to place the conductor in an insulator groove, manipulate the line tie on the insulator with the "Hotstick" and wrap one leg of the line tie about the conductor on one side of the insulator, then wrap the line tie about the neck of the insulator and across the conductor where it overlies the insulator head, and finally wrap the opposite leg of the line tie about the conductor on the opposite side of the insulator. Performance of these steps is tedious and time-consuming, which can further contribute to the linesman neglecting to apply the protective device, i.e., cushioning tube or pad, between the conductor and the insulator. Applying a line tie to an energized conductor in this manner can also be dangerous. A high voltage short circuit may result from contacting a pole, crossarm, or another conductor.

Consequently, a need exists for a line tie design which is easier and safer to apply which secures the conductor to the insulator and will promote deployment of the protective device betwaen the conductor and insulator by the linesman.

SUMMARY OF THE INVENTION

The present invention provides a line tie assembly designed to satisfy the aforementioned needs. The present invention is a line tie assembly which is easy to apply to energized conductors and substantially eliminates the possibility that the protective cushioning device will not be deployed by the linesman. The line tie of the present invention also enables its application with a minimal chance of contacting a pole, crossarm or another conductor because the line tie is secured to the insulator before the energized conductor is placed on the insulator.

The line tie assembly includes two identical single-strand line tie components which make the line tie assembly relatively simple to manufacture and relatively easy to apply. A flexible cushioning pad is disposed in a captured relationship between the tie components. When using the line tie assembly of the present invention, the linesman cannot fail to properly deploy the pad while carrying out securement of the conductor to the insulator. The procedure for applying the line tie assembly is such that use of a "Hotstick" in applying the assembly to a conductor carrying power is relatively easy.

Accordingly, the present invention is directed to a line tie assembly for securing a conductor to a support insulator. The support insulator includes a head portion having a line-receiving groove and a reduced diameter neck portion mounting the head portion. The line tie assembly includes a first single-strand line tie component having a pair of leg portions with helical preformed configurations and a bight portion integrally interconnecting the leg portions. The bight portion hooks about the neck portion of the support and the leg portions wrap about an adjacent portion of the conductor for securing the conductor to the support. The line tie assembly also includes a second single-strand line tie component separate from the first line tie component and havlng a pair of leg portions with helical preformed configurations and a bight portion integrally interconnecting the leg portions. The bight portion of the second line tie component hooks about the neck portion of the support: insulator oppositely from the bight portion of the first tie component. The leg portions of the second line tie component wrap about another adjacent portion of the conductor on an opposite side of the support from the one adjacent line portion for securing the conductor to the support insulator. More particularly, the first and second line tie components are substantially identical.

The present invention is also directed to a line tie assembly which includes a first line tie component for hooking about the neck portion of the support and for wrapping about an adjacent portion of the line for securing the line to the support insulator. A second line tie component separate from the first line tie component hooks about the neck portion of the support oppositely from the first line tie component and wraps about another adjacent portion of the line portion for securing the line to the support. A flexible cushioning device is connected to at least one of the first and second line tie components. The cushioning device is for placment between the line and the groove of the head portion of the support insulator. More particularly, the cusioning device is in the form of a generally flat pad composed of resilient material connected to and extending between bight portions of both of the line tie components. The cushioning pad includes a pair of opposing tabs adapted to releasably attach the pad to the bight portions of the line tie components such that the pad extends therebetween in a captured relationship.

The above and other advantages of the present invention will become apparent to those skilled in the art upon a reading of the following detailed description made with reference to the accompanying drawings wherein there is shown and described an illustrative embodiment of the invention.

BRIEF DESCRIPTION OF THE DRAWINGS

In the course of the following detailed description, reference will be made to the attached drawings, in which.

DETAILED DESCRIPTION OF THE INVENTION

Figure 1:
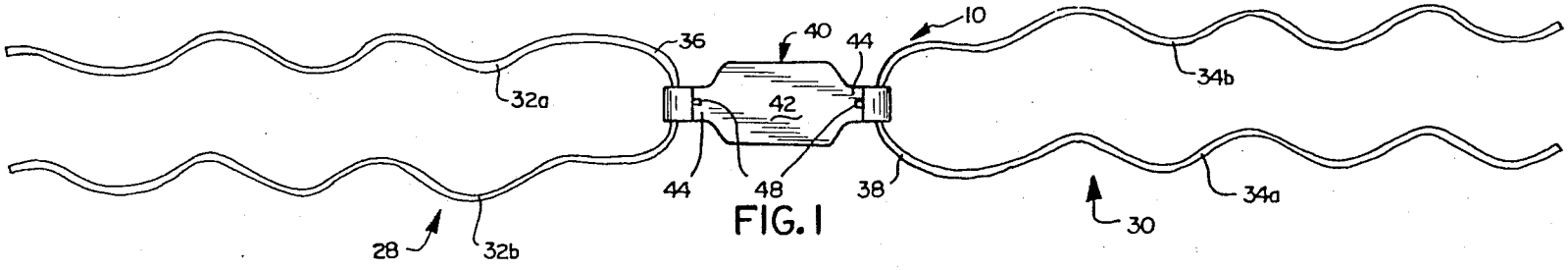
FIG. 1 is a top plan view of the line tie assembly of the present invention illustrating a pair of line tie components and a captured cushioning pad.
Figure 3:
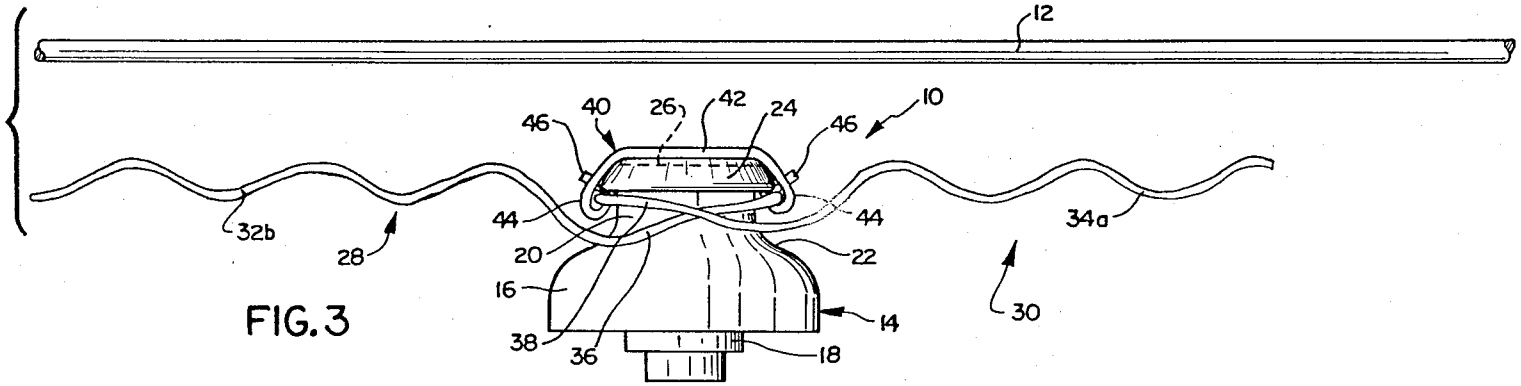
FIG. 3 is a side elevational view of the line tie assembly of FIG. 2 after being applied to the insulator with the captured pad resting in the head of the insulator and the bight portion of the line tie components hooked around opposite sides of the neck of the insulator.
Figure 4:
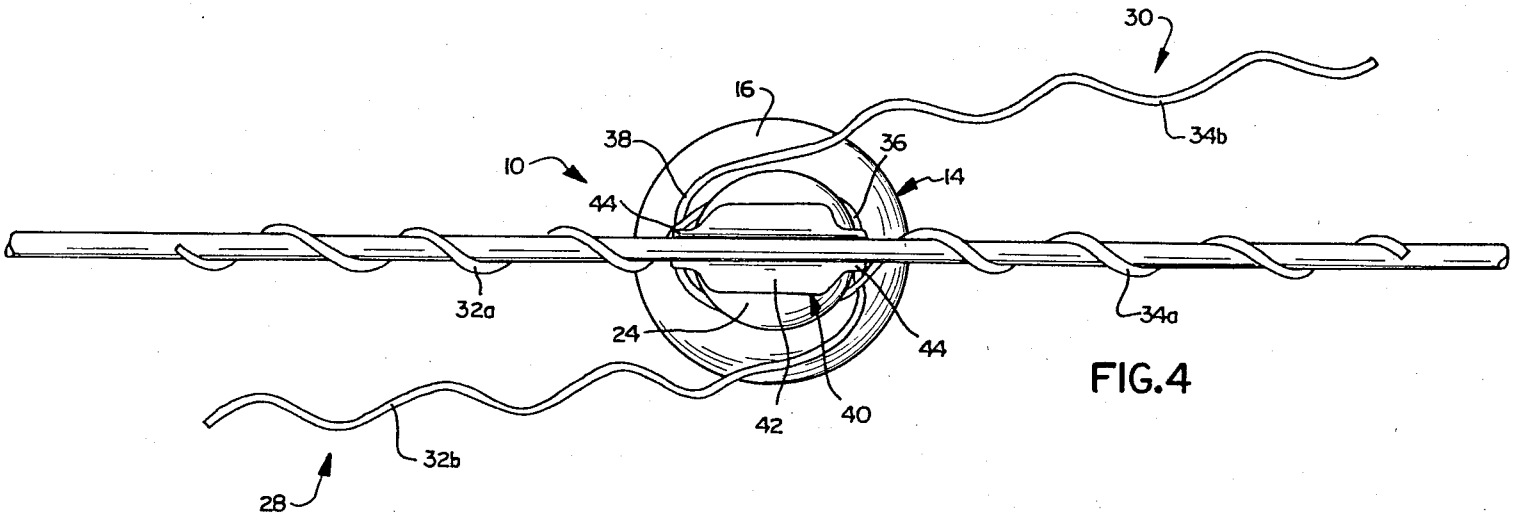
FIG. 4 is a top plan view of the line tie assembly of FIG. 2 after the line conductor has been seated on the captured pad overlying the insulator head and one of the leg portions of each tie component has been wrapped about an adjacent portion of the line conductor.
Figure 5:
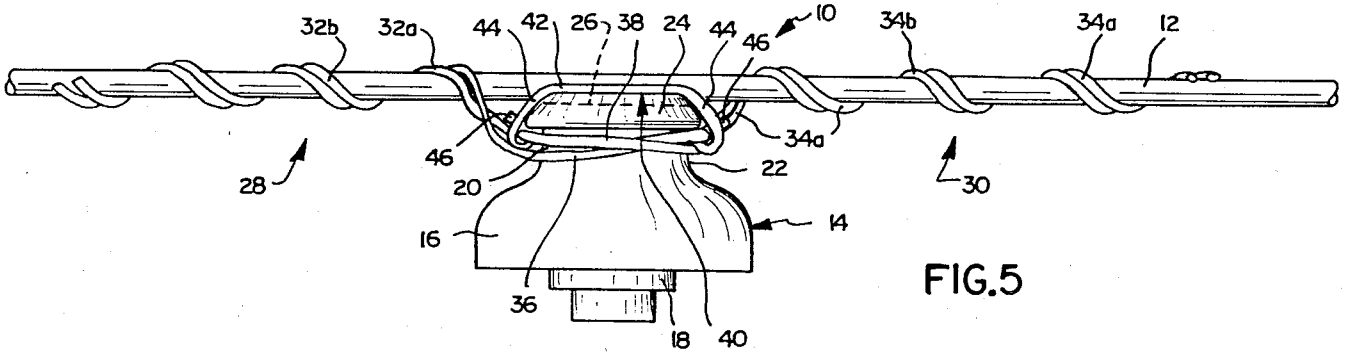
FIG. 5 is a side elevational view of the line tie assembly of FIG. 2 after both leg portions of each tie component have been wrapped about the adjacent portion of the line conductor, securing the conductor to the insulator.
Figure 6:
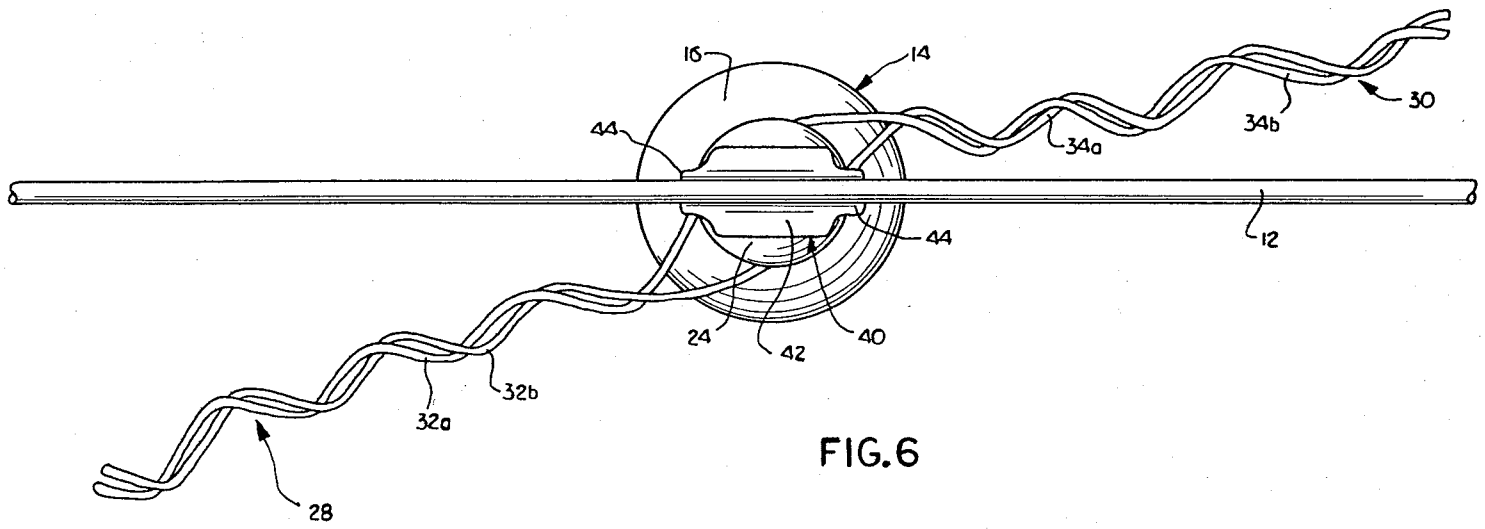
FIG. 6 is a top plan view of the line tie assembly of FIGS. 1 and 2 applied to an insulator for receiving an energized conductor.

Referring now to the drawings, and particularly to FIG. 1, there is shown a line tie assembly generally designated by the numeral 10, incorporating the present invention. As shown in FIGS. 3 to 5, the line tie assembly 10 is applied to an elongated line or line conductor 12 and line support insulator 14 to secure the conductor on the insulator. The line conductor 12 may be insulated or not. The insulator 14 is a known type constructed of suitable material, such as glass or ceramic, which is relatively harder than the insulation or conductive material of the conductor 12. The insulator 14 includes a flared skirt 16 having a bottom annular collar 18 internally threaded for attachment to suitable mounting, for example to a pole or tower. The skirt 16 also has a reduced diameter neck portion 20 defining an annular recess 22 about the insulator 14. Upon the reduced neck portion 20 is formed an upper head portion 24 bisected by a groove 26 defined in the top thereof for receiving the line conductor 12.

Figure 2:
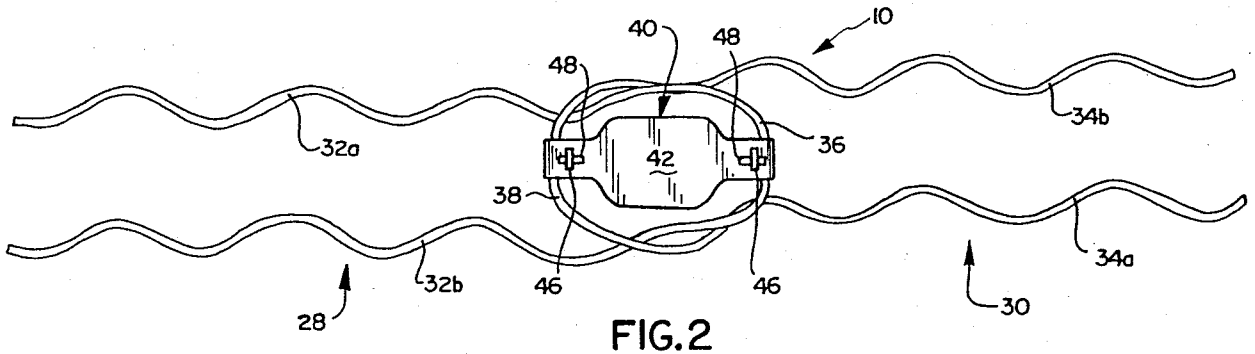
FIG. 2 is a top plan view of the line tie assembly of FIG. 1 after being manipulated to overlap respective bight portions of the separate line tie components of the assembly prior to being applied to an insulator.

As best seen in FIGS. 1 and 2, the line tie assembly 10 includes a pair of substantially identical line tie components 28, 30 each in the form of a single strand of wire. For example, aluminum coated high tensile strength steel wire which is a shape retaining, yieldable wire material may be used to form the line tie components 28, 30. Each line tie component 28, 30 has a pair of generally parallel leg portions **32*a*, 32*b* and 34*a*, 34*b* with helical preformed configurations. A generally U-shaped bight portion 36 and 38 integrally interconnects the leg portions 32*a*, 32*b* and 34*a*, 34*b***.

Also, the line tie assembly 10 includes a flexible cushioning device, preferably, in the form of a generally flat pad 40 composed of resilient material, such as conventional rubber. The flexible cushioning pad 40 is pivotally connected to at least one, and preferably both, of the bight portions 36, 38 of the respective line tie components 28, 30 to provide the pad 40 in a captured relationship thereon. The pad 40, which has a generally rectangular body 42, is connected to the line tie components 28, 30 by a pair of tabs 44 formed at opposite ends of the body 42. As seen in FIG. 3, the tabs 44 are looped about the respective bight portions 36, 38. Locking tips 46 are inserted back through slits 48 defined in the tabs 44 to releasably attach the pad 40 to both tie components 28, 30.

As depicted in FIGS. 3 to 5, the U-shaped configurations of the bight portions 36, 38 of the line tie components 28, 30 are adapted to hook about the neck portion 20. The bight portions 36, 38 seat within the annular recess 22 on diametrically opposite sides of the insulator 14. The helical preformed configurations of the leg portions **32*a*, 32*b*, 34*a*, 34*b* of the tie components 28, 30 are adapted to wrap about respective adjacent portions of the line conductor 12 extending away from the insulator 14. The diameter of the preformed helices of the leg portions 32*a*, 32*b*, 34*a*, 34*b* is preferably slightly less than that of the line conductor 12. A grit material is adhered to the surfaces of the leg portions 32*a*, 32*b*, 34*a*, 34*b*. The helices and grit ensure that the leg portions will positively grip the respective adjacent conductor portions so as to secure them, in a relatively axial immovable relationship, to the insulator 14. Also, a portion of the conductor 12 which extends through the groove 26 is urged downwardly, as viewed in FIG. 5, toward the groove. In view of its captured relationship between the bight portions 36, 38 of the tie components 28, 30, the flexible cushioning pad 40 is positioned over the groove 26 in the insulator head portion 24 and clamped between the conductor 12** and the insulator head portion.

As shown in FIGS. 1 and 2, the helical preformed configurations of the leg portions **32*a*, 32*b* of the line tie component 28 are oriented substantially in phase relative to one another, as are the leg portions 34*a*, 34*b* of the line tie component 30. However, the helical preformed configurations of the leg portions 32*a*, 32*b* of the one line tie component 28 are oriented substantially 180 degrees out of phase with the helical preformed configurations of the leg portions 34 *a*, 34*b* of the other line tie component 30. That is, for example as viewed in FIG. 4, the line tie component 28 is first wrapped to one side of the line 12 while the line tie component 30 is first wrapped to the diametrically opposite side of the line. This is particularly desirable when used with a helically wound uninsulated conductor 12 because the direction of the pitch of the line tie components 28; 30 is generally in phase with the pitch direction of the conductor. This yields the maximum surface area contact between the conductor 12 and line tie components 28, 30** which results in a more positive frictional grip therebetween.

In preparation for applying the line tie assembly 10 to the insulator 14, the pair of line tie components 28, 30 are first manipulated by moving them from the position illustrated in FIG. 1 toward one another so as to invert the pad 40 and place the blght portions 36, 38 of the components in the overlapplng relationship, as illustrated in FIG. 2. Then, the line tie assembly 10 is slipped over the head portion 24 of the insulator 14. This places the pad 40 in overlying relation to the groove 26 and the bight portions 36, 38 are hooked about respective opposite sides of the neck portion 20 of the insulator, as seen in FIG. 3. The conductor 12 is now pulled down against the pad 40. Leg portions 32*a* and 34*a* of the components 28, 30 are successively wrapped about the adjacent portions of the conductor 12. Generally, it is preferred to first wrap the leg portions 32*a*, 34*a* around the conductor 12 at the start of the wrap, as shown in FIG. 4. Then, completion of the securement of the conductor 12 to the insulator 14 is accomplished by successively wrapping the leg portions 32*b* and 34*b* around the conductor 12.

In hot application of the tie assembly 10, that is, when the conductor 12 is carrying electricity, the task is made relatively easy since the assembly is fitted on the insulator 14 before the conductor even needs to be engaged by the tie components of the assembly. Hot application of the tie assembly 10 is also relatively safe with little chance of the leg portions 32*a*, 32*b*, 34*a*, 34*b* of the tie assembly contacting other objects which could cause a high voltage short circuit. Also, by attaching a ring attachment to the end of the "Hotstick " used by the linesman, each of the leg portions 32*a*, 32*b*, 34*a*, 34*b* of the line tie components 28, 30 can be easily manipulated about the conductor 12, thus resulting in a relatively simpler and safer hot application of the assembly 10 to the conductor 12.

While the pad 40 can be attached to only one of the line tie components 28, 30, as was indicated above, to meet the objective of preventing a linesman from neglecting to apply it to the insulator head portion 24, it is preferred that it be attached to both line tie components. Such dual attachment reduces the tendency for the pad to work out from under the conductor 12 over time since the pulling forces transmitted from the line tie components 28, 30 to the pad offset one another. Thus, the dual attachment provides greater assurance that the conductor 12 will not be pulled off the pad 40 in one direction and its softer material will be protected from the harder insulator material.

The line tie assembly of the present invention and many of its attendant advantages will be understood from the foregoing description and it will be apparent that various changes may be made in the form, construction and arrangement of the parts thereof without departing from the spirit and scope of tha invention or sacrificing all of its material advantages, the form hereinbefore described being merely a preferred or exemplary embodiment thereof.

Having described a preferred embodiment of my invention, I claim:

1. A line tie assembly for securing an elongated line to a support therefor, the support including a head portion having a line-receiving groove and a reduced diameter neck portion mounting the head portion, said line tie assembly comprising:

(a) a first line tie component for wrapping about the neck portion of the support and for wrapping about a first adjacent portion of the line for securing the line to the support;

(b) a second line tie component separate from said first line tie component for wrapping about the neck portion of the support diametrically opposite from said first line tie component and for wrapping about a second adjacent portion of the line on an opposite side of the support from the first adjacent line portion for securing the line to the support; and (c) a flexible cushioning device connected to and extending between both of said first and second line tie components in a captured relationship, said cushioning device adapted to be disposed between the line and the groove in the support.

2. The line tie assembly as recited in claim 1, wherein said cushioning device is in the form of a generally flat pad composed of resilient material.

3. The line tie assembly as recited in claim 2, wherein said cushioning pad includes a pair of opposing elements adapted to releasably attach said pad to said line tie components such that said pad extends between said components.

4. The line tie assembly as recited in claim 1, wherein said first and second line tie components are substantially identical single strand wires.

5. The line tie assembly as recited in claim 1, wherein said first line tie component has a pair of leg portions and a bight portion integrally interconnecting said leg portions, said bight portion for hooking about the neck portion of the support and said leg portions for wrapping about the first adjacent portion of the line for securing the line to the support.

6. The line tie assembly as recited in claim 5, wherein said second line tie component has a pair of leg portions and a bight portion integrally interconnecting said leg portions, said bight portion of said second line tie component for hooking about the neck portion of the support diametrically opposite from said bight portion of said first line tie component, said leg portions of said second line tie component for wrapping about the second adjacent portion of the line on an opposite side of the support from the first adjacent line portion for securing the line to the support.

7. The line tie assembly as recited in claim 6, wherein said leg portions of said first line tie component have helical preformed configurations which are oriented substantially in phase.

8. The line tie assembly as recited in claim 7, wherein said leg portions of said second line tie component have helical preformed configurations which are oriented substantially in phase.

9. The line tie assembly as recited in claim 8, wherein said helical preformed configurations of said leg portions of said first line tie component are oriented substantially 180 degrees out of phase with said helical preformed configurations of said leg portions of said second line tie component.

10. A line tie assembly for securing an elongated line to a support therefor, the support including a head portion having a line-receiving groove and a reduced diameter neck portion mounting the head portion, said line tie assembly comprising:

(a) a first single-strand line tie component having a pair of leg portions with helical preformed configurations and a generally U-shaped bight portion integrally interconnecting said leg portions, said bight portion for hooking about the neck portion of the support, said leg portions for wrapping about a first adjacent portion of the line for securing the line to the support;

(b) a second single-strand line tie component separate from said first line tie component and having a pair of leg portions with helical preformed configurations and a generally U-shaped bight portion integrally interconnecting said leg portions, said bight portion of said second line tie component for hooking about the neck portion of the support oppositely from said bight portion of said first line tie component, said leg portions of said second line tie component for wrapping about a second adjacent portion of the line on an opposite side of the support from the first adjacent line portion for securing the line to the support; and (c) a generally flat flexible cushioning pad composed of resilient material and pivotally connected to and extending between said bight portions of said first and second line tie components in a captured relationship, said cushioning pad adapted to be placed between the line and the groove in the support.

11. The line tie assembly as recited in claim 10, wherein said cushioning pad includes a pair of opposing tabs for releasably attaching said pad to said bight portions of said line tie components such that said pad extends therebetween in said captured relationship.

12. The line tie assambly as recited in claim 10, wherein said helical preformed configurations of said leg portions of said first line tie component are oriented substantially in phase.

13. The line tie assembly as recited in claim 10, wherein said helical preformed configurations of said leg portions of said second line tie component are oriented substantially in phase.

14. The line tie assembly as recited in claim 10, wherein said helical preformed configurations of said leg portions of said first line tie component are oriented substantially 180 degrees out of phase with said helical preformed configurations of said leg portions of said second line tie component.

15. A line tie for securing an elongated line to a support therefor, the support including a head portion having a line-receiving groove and a reduced diameter neck portion mounting the head portion, said line tie comprising:

a first tie portion having a pair of legs with helical preformed configurations for wrapping about a first adjacent portion of the line and a U-shaped bight integrally connecting said pair of legs, said bight for wrapping about the neck portion of the support; and a flexible cushion portion for location between the line and the groove in the support, said flexible cushion portion having a body and a tab extending from said body, said tab having means for looping about a portion of said U-shaped bight to pivotally connect said flexible cushion portion with said first tie portion.

16. The line tie set forth in claim 15 wherein sid means for looping about a portion of said U-shaped bight further includes said tab being integrally formed as one piece with said body and said tab having an opening for receiving a tip portion of said tab.

17. The line tie set forth in claim 16 further including:

a second tie portion having a pair of legs with helical preformed configurations for wrapping about a second adjacent portion of the line extending in a direction opposite the first adjacent portion of the line and a U-shaped bight integrally connecting said pair of legs, said bight for wrapping about the neck portion of the support; and said flexible cushion portion having means for looping about a portion of said U-shaped bight of said second tie portion including a second tab integrally formed as one piece with said body and having an opening for receiving a tip portion of said second tab to pivotally connect said flexible cushion portion with said second tie portion.

18. A line tie assembly for securing an elongated line to a support therefor, the support including a head portion having a line-receiving groove and a reduced diameter neck portion mounting the head portion, said line tie assembly comprising:

a first line tie component having a pair of leg portions with helical preformed configurations and a generally U-shaped bight portion integrally intarconnecting said leg portions, said bight portion for hooking about the neck portion of the support, said leg portions for wrapping about a first adjacent portion of the line to secura the line to the support;

a second line tie component separate from said first line tie component and having a pair of leg portions with helical preformed configurations and a generally U-shaped bight portion integrally interconnecting said leg portions, said bight portion of said second line tie component for hooking about the neck portion of the support oppositely from said bight portion of said first line tie component, said leg portions of said second line tie component for wrapping about a second adjacent portion of the line on an opposite side of the support from the first adjacent line portion to secure the line to the support; and a generally flat flexible cushioning pad composed of resilient material and pivotally connected to and extending between said bight portions of said first and second line tie components, said cushioning pad adaptad to be placed between the line and the groove in the support.

19. The line tie assembly as recited in claim 18, wherein said cushioning pad includes a pair of opposing tabs for releasably attaching said pad to said bight portions of said line tie components such that said cushioning pad extends therebetween.

20. The line tie assembly as recited in claim 18, wherein said helical preformed configurations of said leg portions of said first line tie component are oriented substantially in phase.

21. The line tie assembly as recited in claim 18, wherein said helical preformed configurations of said leg portions of said second line tie component are oriented substantially in phase.

22. The line tie assembly as recited in claim 18, wherein said helical preformed configurations of said leg portions of said first line tie component are oriented substantially 180 degrees out of phase with said helical preformed configurations of said leg portions of said second line tie component.

* * * * *